United States Patent [19]

Samson et al.

[11] 4,059,274

[45] Nov. 22, 1977

[54] BOARD GAME INCLUDING CODE DEFINING PLAYING PIECES

[76] Inventors: Ronald Samson, Harborough Road, Oadby, Leicester LE2 4LB; Derrick Botterill, 17, Lincoln Close, Tupsley, Hereford, both of England

[21] Appl. No.: 650,417

[22] Filed: Jan. 19, 1976

[51] Int. Cl.[2] ..... A63F 3/00

[52] U.S. Cl. ..... 273/130 D; 273/136 R

[58] Field of Search ..... 273/130 R, 130 D, 136 C, 273/136 E, 137 R, 148 R, 130 AB

[56] References Cited

U.S. PATENT DOCUMENTS

| | | | |
|---|---|---|---|
| 2,545,415 | 3/1951 | Podd | 273/135 R |
| 4,022,473 | 5/1977 | Foley | 273/130 R |

*Primary Examiner*—Richard C. Pinkham
*Assistant Examiner*—Harry G. Strappello
*Attorney, Agent, or Firm*—Diller, Brown, Ramik & Wight

[57] ABSTRACT

The invention relates to a board game to test the deductive reasoning and logical thinking of two or three players. Each player is chosen in turn as code-maker and for each game selects, for example, five key playing pieces each displaying two characteristics, one of, say, shape and the other of, say, color. The other player(s) attempt to break the code by identifying the selected pieces by a process of logical deduction, involving the presentation of test playing pieces of both characteristics for checking by the code-maker.

6 Claims, 1 Drawing Figure

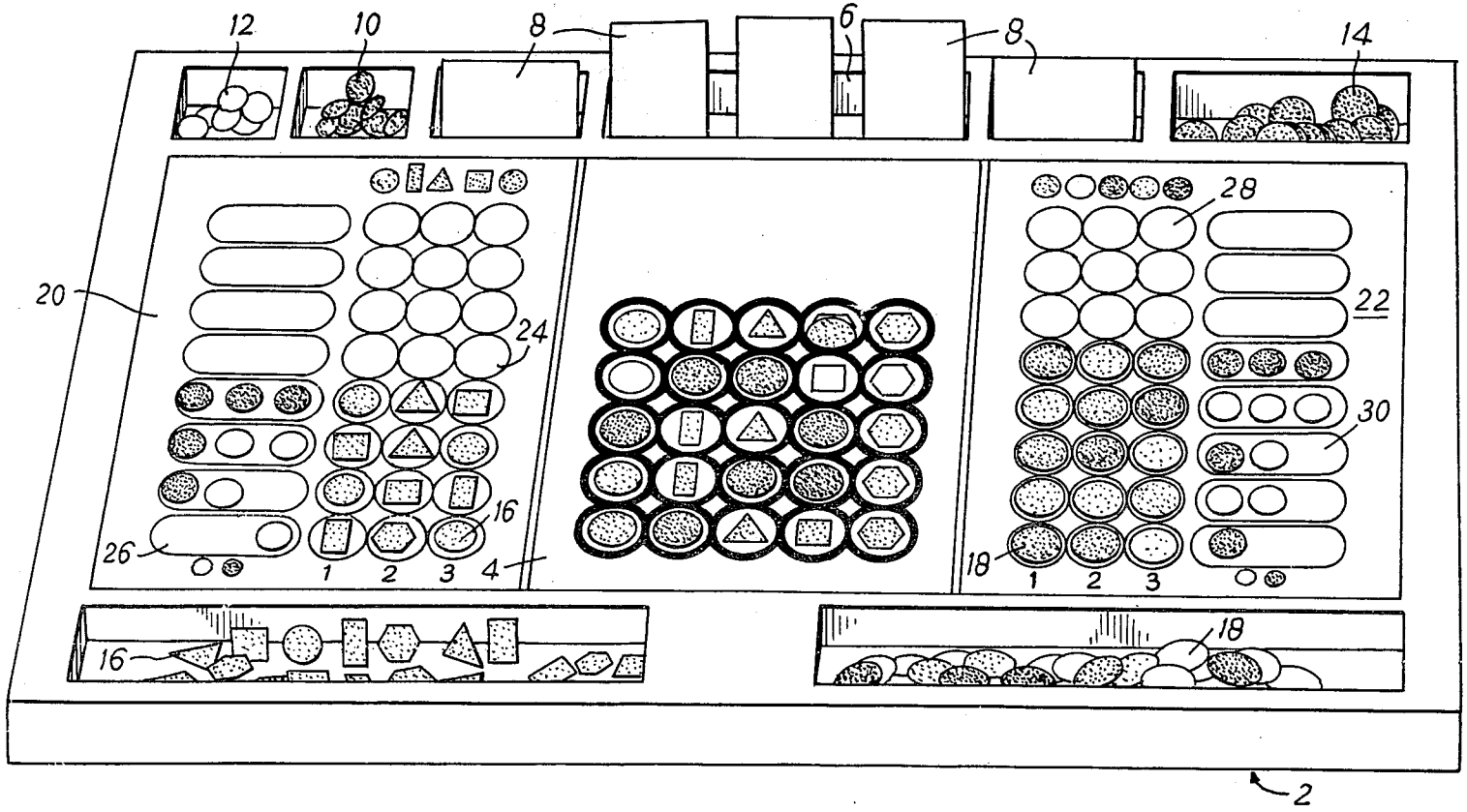
2
4
6
8
8
10
12
14
16
16
18
18
20
22
24
26
28
30
1
2
3
1
2
3

BOARD GAME INCLUDING CODE DEFINING PLAYING PIECES

The invention relates to a board game for two or three players which has been devised to enable a player to apply his powers of deductive reasoning and logical thinking in solving a problem posed by another player. The principle is that points shall be awarded for a solution of the problem and the roles of the players shall be periodically exchanged. The total points secured over a series of problems shall provide the winner.

The invention provides a board game comprising a board, a plurality of key playing pieces each having two characteristics, one of which is from a first series of contrasted characteristics and the second of which is from a second series of contrasted characteristics, said playing pieces being adapted to be mounted on a reserved area of the board in a pattern chosen at will by a player to serve as a target code, means for shielding the chosen code of playing pieces when so mounted, a plurality of first test playing pieces conforming with the key playing pieces in respect of the first of said series of characteristics, a plurality of second test playing pieces conforming with the key playing pieces in respect of the second of said series of characteristics, each plurality of test playing pieces being mountable in one of two designated positions on the board in successive groups with the object of simulating the respective characteristics of the key playing pieces in the code pattern, and marker elements for mounting on said board to signal the correctness of the characteristics and relative position of the test playing pieces in each successive group.

Preferably a plan is provided bearing representations of all the key playing pieces and which is adapted to monitor the identification of the key playing pieces to remind the player using the test playing pieces of those key playing pieces which have already been correctly identified at a previous round of each game.

In playing the game, one player will choose a target code comprising a selection of key playing pieces in a random order and will mount them in a reserved area and shield them from view by his opponent (s). Because each key playing piece bears two characteristics, and two sets of test playing pieces are used, each bearing one characteristic only, it is possible either for one opponent to use both sets of test playing pieces, or for each set to be in the hands of one of two opponents, thereby enabling three persons to partake in the game.

In either case, test playing pieces are then selected and exposed on the board in groups for review by the first player. The results of this first selection are then marked by the first player using the marker elements. Preferably test playing pieces are selected for characteristics of both series before progressing to the presentation of the next successive groups.

The marker elements are arranged to indicate (a) the number of test playing pieces of correct characteristics and (b) the number of test playing pieces of correct characteristics which are also correctly positioned.

The second, or second and third, player(s) will then set out second groups of test playing pieces. In doing so, he/they will have some pre-knowledge, or surmise, of some of the pattern of the target code and the second group is used to test further possibilities. This second group is also marked by the first player. Play will continue until the correct characteristics of both series have been identified. This will end one round and marks will be assessed and recorded.

The players now change roles, either in direct exchange, if two are playing, or one challenging player changes with the first, challenged, player. This exchange will take place after each round until each player has been in the challenger position for predetermined number of times.

A specific embodiment of the invention will now be described with reference to the accompanying drawing. It will be understood that the following description is given by way of example of the invention only and not by way of limitation thereof.

The drawing shows a board marked out for play, key playing pieces, two sets of test playing pieces, a plan, and marker elements.

The board 2 is divided into a plurality of regions. A centrally disposed region 4 represents a plan displaying representations of twenty five key playing pieces, and immediately above the plan 4 is a recessed region 6 containing twenty five cards 8, the key playing pieces themselves, each of which bears two characteristics, one of colour and one of shape. No two key playing pieces show the same combination of characteristics.

To the left of the recessed region 6 is a region for containing marker elements in the form of small black counters 10, and white counters 12. To the right of the region 6 is a recessed region for containing large black counters 14 which are used to obscure the representations on the plan 4 as the corresponding key playing piece is correctly identified and its position found.

To the left of the board and at the bottom as viewed in the drawing, is a recessed region containing fifty test playing pieces of a neutral colour. These comprise shaped counters 16, there being ten counters of each of five shapes which correspond to the shape characteristics of the key playing pieces 8.

To the right of the board and at the bottom as viewed in the drawing, is a recessed region containing a further fifty test playing pieces comprising coloured counters, 18. This comprises ten counters of each of five colours which correspond to the colour characteristics of the key playing pieces 8.

Two playing surfaces 20, 22 are designated on the board, the surface 20 being for use with the test playing pieces 16, and the surface 22 with the test playing pieces 18.

The area 20 is divided into two areas, the righthand one of which is marked with eight horizontal rows of three white circles 24, upon which the test playing pieces 16 are placed three at a time. Each row of white circles has an oblong area 26 marked to its left, upon which the first player, i.e., the challenged player, indicates the correctness or otherwise of the test playing pieces 16 exposed on the appropriate white circles 24, by means of the marking elements, counters 10 and 12. If any test playing piece presented is incorrect in its characteristic (shape or colour), no marking element is displayed.

The presence of one black counter on an oblong area 26 denotes that one test playing piece is of the correct characteristic and is in the correct position. If the piece is of the correct characteristic but is not in the correct position, a white counter is used. The counters do not however, indicate to which piece reference is being made.

A similar arrangement of areas is shown on the playing surface 22. Here, white circles 28 receive the test playing pieces 18, and the correctness of each selection is indicated on oblong areas 30 with the marking elements 10 and 12 in the manner described above.

The rules for play with two persons are described below, with a further description of an alternate mode of play with three persons.

The first player, hereinafter referred to as the codemaker, secretly selects three key playing pieces 8 and sets them up as shown in the drawing out of view of the other player, the codebreaker. The codebreaker has up to eight opportunities to ascertain the characteristic of colour of the three selected key playing pieces 8 and up to eight opportunities to ascertain the characteristic of shape of the three pieces 8. For every row of white circles 24 and 28 which the codebreaker uses in his attempts, the codemaker scores one point. The ascertainment of the colour and shape characteristics of one set of three key playing pieces constitutes one round. All test playing pieces and marking elements remain in place for the duration of each round.

After each round, the players exchange positions and record their score. Black counters 14 are placed over the appropriate representations on the plan 4, to remind the codebreaker that these pieces have been played. The next round uses twenty two key playing pieces only. The game is over when the players have had an equal number of rounds, up to four rounds each. The player with most points is the winner.

It will be appreciated that the importance of the plan 4 increases as the rounds progress, since in each succeeding game there are three fewer pieces and the number of permutations of characteristics is reduced. When twenty five key playing pieces are available in the first round, there are 13,800 possible permutations. It is obvious that as each game progresses the information contained on two areas 20 and 22 begin to relate more and more to each other and thus presents an increasing test of the logical and deductive powers of the codebreaker.

As a slight alternative, one player may remain codemaker for all eight rounds. A further game of eight rounds is then played after the players have exchanged. Scores are then compared at the end of each game of eight rounds.

In the alternative version in which three players take part, the rules are as described, where appropriate. One codebreaker puts forward the test playing pieces 16 to ascertain the shape characteristics of the codemakers three selected key playing pieces 8, and the second codebreaker puts forward the test playing pieces 18 to ascertain the colour characteristics. At the end of each round, the numbers of rows of white circles 24 and 28 used by both codebreakers are added together and the codemaker claims the total as his score.

The board is turned in a clockwise direction between rounds so that each player in turn is the codemaker. To minimise any advantage to the player who is third codemaker, the first three games are played with all twenty five key playing pieces, and in order to remove three key playing pieces after the third round, the pieces are shuffled, three removed and marked on the plan 4, and play continues for another three rounds after which the remaining twenty two key playing pieces are shuffled and three more removed.

The winner is the codemaker with the highest score.

We claim:

1. A board game comprising a board, said board having a reserved area and two areas defining designated positions, a pluraity of key playing pieces having two characteristics, one of which is from a first series of contrasted characteristics and the second of which is from a second series of contrasted characteristics, said playing pieces being adapted to be mounted on said reserved area of the board in a pattern chosen at will by a player to serve as a target code, means for shielding the chosen code of playing pieces when so mounted, a plurality of first test playing pieces conforming with the key playing pieces in respect of the first of said series of characteristics, a plurality of second test playing pieces conforming with the key playing pieces in respect of the second of said series of characteristics, each plurality of test playing pieces being mountable in one of said two designated positions on the board in successive groups with the object of simulating the respective characteristics of the key playing pieces in the code pattern, and marker elements for mounting on said board to indicate the correctness of the characteristics and relative position of the test playing pieces in each successive group.

2. A board game as claimed in claim 1 wherein the first series of contrasted characteristics comprise a series of contrasted shapes and the second series of contrasted characteristics comprise a series of contrasted colours.

3. A board game as claimed in claim 1 wherein the board is provided with a plan bearing representations of all the key playing pieces and serving to monitor the identification of the key playing pieces.

4. A board game as claimed in claim 1 wherein the key playing pieces are in the form of cards and the test playing pieces are in the form of counters.

5. A board game as claimed in claim 1 wherein there are twenty five key playing pieces and fifty test playing pieces each having a characteristic from the first series of characteristics and fifty test pieces each having a characteristic from the second series of characteristics.

6. A board game as claimed in claim 1 wherein each key playing piece has said two characteristics.

* * * * *